US005485355A

United States Patent [19]

Voskoboinik et al.

[11] Patent Number: 5,485,355

[45] Date of Patent: Jan. 16, 1996

[54] ELECTROLUMINESCENT LIGHT SOURCES

[75] Inventors: Moses Voskoboinik; Israel Baumberg, both of Maaleh Adumim; Joseph S. Bodenheimer, Jerusalem, all of Israel

[73] Assignee: Elam-Electroluminescent Industries Ltd., Jerusalem, Israel

[21] Appl. No.: 163,340

[22] Filed: Dec. 6, 1993

[30] Foreign Application Priority Data

Dec. 10, 1992 [IL] Israel ..... 104052

[51] Int. Cl.[6] ..... H05B 33/02

[52] U.S. Cl. ..... 362/84; 362/217; 313/511; 313/512; 313/358; 428/217

[58] Field of Search ..... 313/511, 512, 313/358; 362/84, 217, 223; 428/917, 690

[56] References Cited

U.S. PATENT DOCUMENTS

| | | | |
|---|---|---|---|
| 2,684,450 | 7/1949 | Mager | 313/108 |
| 2,838,715 | 8/1950 | Payne | 315/108 |
| 3,052,812 | 12/1959 | Dow | 313/108 |
| 3,069,579 | 10/1962 | Berg et al. | 313/511 |
| 3,371,243 | 2/1968 | Bramley et al. | 313/358 |
| 3,571,647 | 3/1971 | Robinson | 313/108 |
| 3,792,308 | 2/1974 | Ota | 313/511 |
| 3,819,973 | 6/1974 | Hosford | 313/498 |
| 4,020,389 | 4/1977 | Dickson et al. | 313/512 |
| 4,855,190 | 8/1989 | Bezner . | |

FOREIGN PATENT DOCUMENTS

| | | | |
|---|---|---|---|
| 3742412 | 6/1989 | Germany | H01B 7/02 |

*Primary Examiner*—Ira S. Lazarus
*Assistant Examiner*—Thomas M. Sember
*Attorney, Agent, or Firm*—Schweitzer Cornman and Gross

[57] ABSTRACT

A cable-like electroluminescent light source comprises at least two electrodes mutually disposed in such a way as to create between them an electric field when a voltage is applied to them; at least one type of pulverulent electroluminophor dispersed in a dielectric binder and disposed in such proximity to the electrodes as to be effectively excited by the electric fields when created and to emit light of a specific color, and a transparent polymer sheath encasing the electrodes and the electroluminophor.

2 Claims, 2 Drawing Sheets

ELECTROLUMINESCENT LIGHT SOURCES

The present invention relates to electroluminescent light sources, in particlar to linear, flexible monochrome or polychrome electroluminescent light sources.

Electroluminescent (EL) point light sources—light-emitting diodes and EL area light-emitting screens—are well known. The drawback of light-emitting diodes is their very small emission area and the directionality of the emitted light.

At present, EL screens on flexible polymer bases are also known. Such screens are constructed essentially as follows: a transparent flexible substrate material, with a layer of transparent conductor applied upon it, is the first electrode. A layer of electroluminophor powder within a dielectric binder is applied upon the conductive layer, and one more conductive layer, the second electrode, is applied upon the former. Under an applied DC voltage, such a screen emits light, the color of which depends on the type of electroluminophor.

An EL screen may also operate from a source of alternating voltage, if one introduces an additional transparent dielectric layer, applied between the transparent electrode and the layer of electroluminophor powder within the dielectric binder.

The drawback of these structures is their limited flexibility and anisotropy of their light emission. Neither of these sources presents a solution to the requirement of an essentially linear light source that can be flexibly shaped into various shapes at will, and which can radiate light uniformly in all directions.

It is one of the objects of the present invention to overcome the drawbacks and disadvantages of prior art EL light sources, and to provide a flexible, shapeable, monochrome, linear EL light source which radiates light uniformly in all directions.

It is a further object of the present invention to provide a flexible, shapeable, polychrome, linear EL light source with similar isotropic light-emitting properties.

It is yet a further object of the invention to provide such a polychrome, linear EL light source, the colors of the light emitted by which are variable.

According to the invention, this is achieved by providing a cable-like EL light source, comprising at least two electrodes mutually disposed in such a way as to create between them an electric field when a voltage is applied to them; at least one type of pulverulent electroluminophor dispersed in a dielectric binder and disposed in such proximity to said electrodes as to be effectively excited by said electric field when created and to emit light of a specific color, and a transparent, polymer sheath encasing said electrodes and said electroluminophor.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

Figure 1:
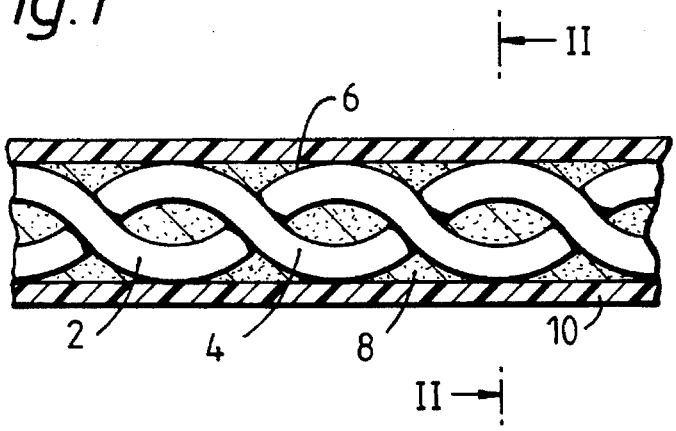
FIG. 1 is a view in longitudinal cross-section of an embodiment of the EL light source according to the invention, having a pair of twisted electrodes.
Figure 2:
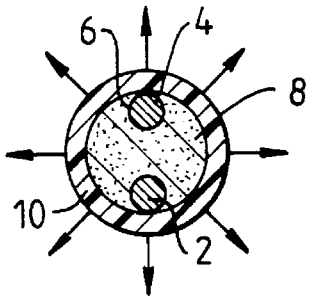
FIG. 2 is a view in cross-section along plane II—II, of the EL source of FIG. 1.

Referring now to the drawings, there is seen in FIGS. 1 and 2 a longitudinally extending, cable-like EL light source incorporating a twisted pair of electrodes 2 and 4 made of copper wire 0.1–0.3 mm in diameter, covered with a layer of insulating lacquer 6, and twisted around each other with a twisting pitch of 8–10 turns per cm. Helical hollows formed between the twisted wires are filled with an EL material 8 comprising an electro- luminophor powder dispersed in an epoxy resin. Electroluminophor powders are commercially available, e.g., from Sylvania GTE (U.S.A.). Powder concentration in the resin amounts to 1.5:1 to 2:1 by weight. Fully encasing the twisted electrodes 2, 4 is a flexible transparent layer 10 of polyvinyl chloride 0.5–0.6 mm thick.

To render this structure operative as a light source, an AC voltage of a frequency preferably in the range of 50–20,000 Hz and of an amplitude preferably from 100–300 V is applied between electrodes 2 and 4 from a power source (not shown). Thus, the particles of the electroluminophor powder are subjected to an alternating electric field and emit light. The color of the light emitted depends essentially on the type of electro- luminophor powder used. Light emission in this and the other embodiments described further below is essentially isotropic all around the cable-like light source, as indicated by the arrows in FIGS. 2 and 4.

Figure 3:
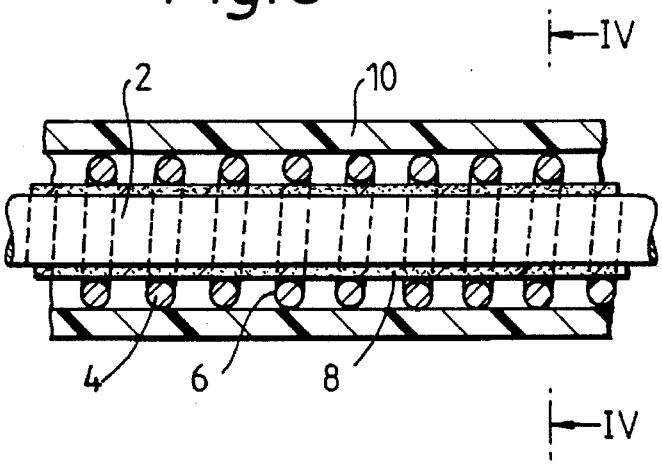
FIG. 3 represents a longtidinal cross-section of another embodiment of the E1 source having a central electrode.
Figure 4:
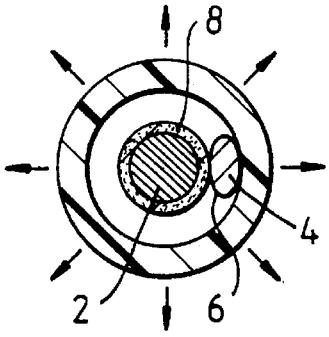
FIG. 4 is a view in cross-section, along plane IV—IV, of the EL source of FIG. 3.

The embodiment shown in FIGS. 3 and 4 comprises a central electrode 2 in the form of a copper wire 0.5–3.0 mm in diameter, coated with a layer of EL material 8, consisting of an electro- luminophor powder dispersed in an epoxy resin at the proportion of 1.5:1 to 2:1 by weight. This layer is 0.1–0.2 mm thick.

Around this layer is wound a second electrode 4, consisting of a copper wire, 0.1–0.3 mm in diameter, coated with an insulating layer of lacquer 6. A clearance of 0.1–0.2 mm is provided between the turns of the wire electrode 4. The structure is fully encased in a flexible transparent polymer sheath 10. To render this structure operative as a light source, an AC voltage of a frequency preferably in the range of 50–20,000 Hz and of an amplitude of 100–300 V is applied between electrodes 2 and 4. Thus, the particles of the electroluminophor powder are subjected to an alternating electric field and emit light, which exits through the clearances between the turns. The color of light emitted by the light source depends essentially on the type of electroluminophor powder used.

Figure 5:
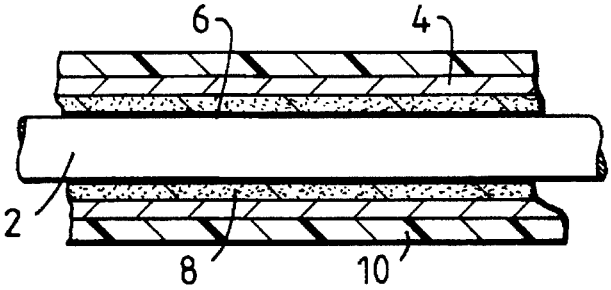
FIG. 5 is a cross-sectional view of a further embodiment of the EL source, having coaxial electrodes.

FIG. 5 represents an EL light source structure of a coaxial configuration. The central electrode 2 is a copper wire, 0.2–5.0 mm in diameter, coated with an insulating layer of lacquer 6. The layer of EL material 8, comprising an electroluminophor powder dispersed in an epoxy resin at the proportion of 1.5:1 to 2:1, by weight, is applied to the central electrode 2 over the lacquer 6. The EL layer 8 is 0.1–0.2 mm thick. A second electrode 4 is constituted by a transparent conductive layer such as tin dioxide about 1 μ thick, which is applied over the layer of EL material 8. The whole structure is fully encased in a flexible, transparent polymer sheath 10.

To render this structure operative as a light source, an AC voltage of a frequency preferably in the range of 50–20,000 Hz and of an amplitude preferably from 100–300 V is applied between the first, central, electrode 2 and the second electrode 4 in the form of a conductive layer. Thus, the particles of the electro- luminophor powder are subjected to an alternating electric field between the electrodes 2 and 4 and emit light which exits through the transparent second electrode 4 and the transparent sheath 10. The color of the light emitted by the source depends essentially on the type of electroluminophor powder used.

Figure 6:
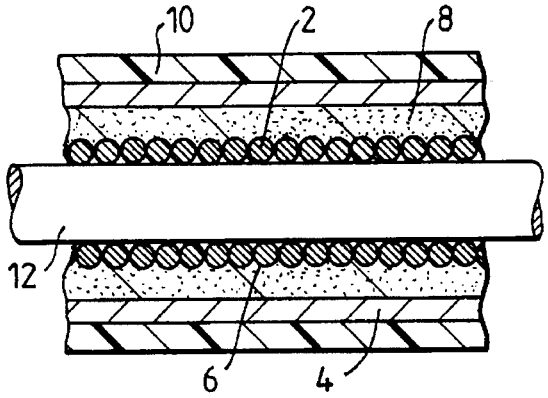
FIG. 6 is a cross-sectional view of an embodiment of the EL source having a flexible dielectric core.

FIG. 6 represents an EL light source structure incorporating a flexible dielectric core 12. Electrode 2 is a copper wire 0.1–0.3 mm in diameter coated with an insulating layer of lacquer 6 and wound helically around a core in the form of a plastic cord of diameter 3–10 mm. The winding pitch of the electrode 2 approximately equals the electrode diameter. Applied over the windings of electrode 2 is a layer of EL material 8, comprising an electroluminophor powder dispersed in an epoxy resin at the proportion of1.5:1 to 2:1 by weight. The layer of EL material 8 is 0.1–0.2 mm thick. Over this layer is applied a second electrode 4, constituting a transparent conductive layer. The whole structure is fully encased in a transparent polymer sheath 10. To render the structure operative as a light source, an AC voltage of a frequency preferably in the range of 50–20,000 Hz and of an amplitude preferably from 100–300 V, is applied between the first electrode 2 and the second electrode 4 in the form of the conductive layer. Thus, the particles of the electroluminophor powder are subjected to an alternating electric field between the electrodes 2 and 4, and emit light which exits through the transparent layers 4 and 10. The color of the light emitted depends essentially on the type of electroluminophor powder used.

Figure 7:
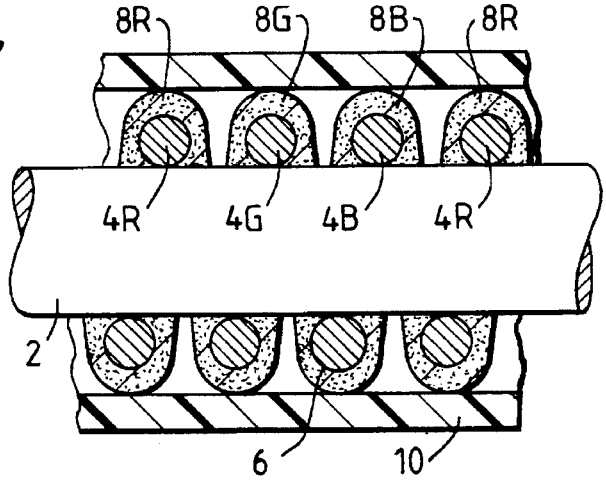
FIG. 7 represents a polychrome EL light source with a common central electrode.

EL light sources according to this invention can also be designed to produce polychromatic light. A first embodiment of such an EL source is illustrated in FIG. 7.

There are provided a central electrode 2, a copper wire 1–3 mm in diameter, as well as three copper wire electrodes 4R, 4G and 4B, with R standing for red, G for green, and B for blue. These electrodes are each of a diameter of 0.1–0.2 mm and are coated with an insulating layer of lacquer 6. On top of these lacquer layers, the electrodes 4R, 4G and 4B are coated with 0.1–0.2 mm-thick layers of EL material 8R, 8G and 8B (for emitting red, green and blue light), respectively, and are then wound, preferably in a triple helix, around the central electrode 2, with a clearance of 0.1–0.2 mm between adjacent coats. The structure is then fully encased in a transparent polymer sheath 10.

To render this structure operative as a polychromatic source, AC voltages of a frequency preferably in the range of 50–20,000 Hz and of amplitudes preferably in the range of 100–300 V are applied between the central electrode 2 and any of the electrodes 4R, 4G or 4B. The powder particles in the respective EL materials 8R, 8G or 8B, subjected to an alternating electric field, will emit red, green, or blue light respectively. The light exits through the clearances between the turns and through the transparent sheath 10 in such a way that the whole structure seems to emit the light of this color. If electrodes 4R, 4G and 4B are electrically connected together and the voltage applied between them and electrode 2, then each of the layers 8R, 8G and 8B will emit light of its own color, and the eye will perceive the combined color emitted by the light source as a whole to be substantially white. If different AC voltages of the above frequency and amplitude range are applied between electrode 2 and each of the electrodes 4R, 4G and 4B, the light source may emit any color depending on the frequency and amplitude of the voltage applied to each of the electrodes 4R, 4G, 4B.

Thus, one can control and continuously change the color (hue, saturation and brightness) of the light emitted by the source, by adjusting the amplitudes or frequencies of the voltages on the electrodes. Switching between colors discontinuously is achieved by discrete voltage changes.

Figure 8:
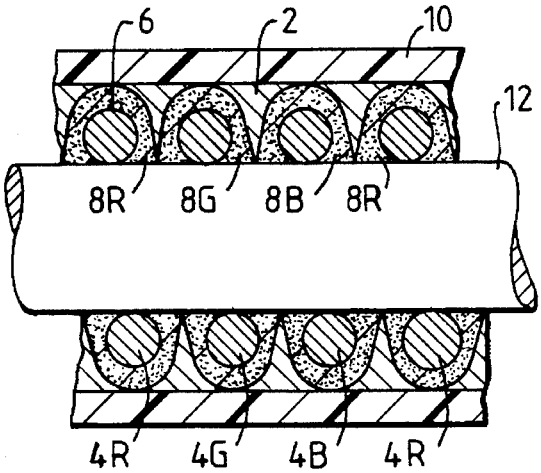
FIG. 8 shows a similar polychrome source with a flexible dielectric core.

The embodiment of FIG. 8, while operating on the same principle, is slightly different in structure, inasmuch as there is provided a flexible dielectric core 12 for the electrodes 4R, 4G and 4B to be wound upon. The electrode 2, on the other hand, is in the form of a transparent, electrically conductive layer applied over, and fully embedding, the electrodes 4R, 4G and 4B and their respective EL material coating (a sequence which is, of course, repeated along the entire length of the triple helix).

Operation of this embodiment is entirely analogous to that of the previous embodiment of FIG. 7.

All the embodiments of the EL light source according to the invention are advantageously linear, but flexible and can be made to assume any desired shape.

The electrodes act essentially as a capacitor, and can thus be used as an element with reactive impedance in an electronic resonance circuit, so that a relatively low input voltage suffices to generate EL radiation.

Furthermore, a series of EL sources with electroluminophors emitting different colors can each be incorporated in electronic resonance circuits, each responsive to a different frequency.

Such a series, when connected to a microphone, can act as a sound-to-color transducer. In the resonant circuits, instead of using inductors, it would be advantageous to use the inductance of the EL electrodes wound around a magnetic core.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed:

1. A cable-like electroluminescent light source, comprising:

a cable-like, flexible and shapeable structure including a dielectric core, a first electrode and three further electrodes wound about said dielectric core and forming a triple helix, said first and each of said three electrodes being mutually disposed in such a way as to create between them an electric field when a voltage is applied to them, at least one of said electrodes being electrically insulated, each of said three electrodes being coated with a different electroluminophor powder, emitting, when excited, light of a different color, controllable with respect to hue, saturation and brightness, and a transparent polymer sheath encasing said electrodes and said electroluminophors.

2. A cable-like electroluminescent light source, comprising:

a cable-like, flexible and shapeable structure including a dielectric core, a first electrode and three further electrodes wound about said dielectric core and forming a triple helix, said first and each of said three electrodes being mutually disposed in such a way as to create between them an electric field when a voltage is applied to them, at least one of said electrodes being electrically insulated, each of said three electrodes being coated with a different electroluminophor powder, emitting, when excited, light of a different color, controllable with respect to hue, saturation and brightness, and a transparent polymer sheath encasing said electrodes and said electroluminophors, wherein the first electrode is a common electrode and comprises a transparent, electrically conductive layer surrounding and embedding said triple helix.

* * * * *